United States Patent [19]

Langen

[11] 3,937,458

[45] Feb. 10, 1976

[54] ROTARY TRANSFER MECHANISM

[75] Inventor: Marinus J. M. Langen, Rexdale, Canada

[73] Assignee: H. J. Langen & Sons Ltd., Rexdale, Canada

[22] Filed: June 3, 1974

[21] Appl. No.: 475,444

[52] U.S. Cl. ..... 271/95; 271/99

[51] Int. Cl.[2] ..... B65H 3/08; B65H 3/05

[58] Field of Search ..... 271/95, 94, 96, 99, 104, 271/91, 108, 11, 12, 13

[56] References Cited

UNITED STATES PATENTS

| | | | |
|---|---|---|---|
| 2,611,299 | 9/1952 | Rose et al. | 271/95 |
| 2,915,308 | 12/1959 | Matzen | 271/95 X |
| 3,682,470 | 8/1972 | Takagi et al. | 271/95 |

*Primary Examiner*—John J. Love
*Assistant Examiner*—Bruce H. Stoner, Jr.
*Attorney, Agent, or Firm*—Fetherstonhaugh & Co.

[57] ABSTRACT

In a rotary transfer mechanism for transferring items from a dispenser station to receiver station including a stationary sun gear, a carriage rotatable with respect to the sun gear and having a planetary gear meshed with an idler gear which is meshed with the sun gear and pick-off arm means connected to and rotatable with the planetary gear, the improvement wherein the gear ratio of stationary gear with respect to planetary gear is 3:2 and the radial extent of the pick-off arm from the axis of the planetary gear is twice the pitch center distance between the stationary gear and the planetary gear. This provides movement of the pick-off arm to and from the dispenser station and receiver station in an arcuate path with the suction cup of the pick-off arm remaining outwardly directed with respect to the axis of the sun gear in all of its travel along a predetermined path.

1 Claim, 4 Drawing Figures

ROTARY TRANSFER MECHANISM

FIELD OF INVENTION

This invention relates to rotary transfer mechanism. In particular, this invention relates to a rotary transfer mechanism suitable for use as a carton dispenser or coupon placer or the like.

PRIOR ART

Rotary transfer mechanisms which employ a pick-off arm with a suction cup which is moved in a generally hypotrochoidal path between a dispenser station and a receiver station are known. A typical example of an apparatus of this type is described in U.S. Pat. No. 2,915,308, dated Dec. 1, 1959, Julius C. Matzen. In this apparatus, the path of travel of the pick-off arm is illustrated as extending inwardly of the axis of rotation of the pick-off gear during movement between the dispenser station and the receiver station. It follows that the items carried by the transfer suction cups must be sufficiently small to pass between the various arms and support shafts of the mechanism. Because of the gear ratio of the planetary gears with respect to the sun gear, it will be apparent that the planetary gears rotate relatively rapidly in response to rotation of the housing about the sun gear. It follows that the pick-off mechanism carried by the planetary gears also moves rapidly so that an apparatus of this type is not particularly well suited for the transfer of items other than light-weight coupons.

A further example of the prior art is illustrated in U.S. Pat. No. 3,302,946, dated Feb. 7, 1967, P. L. Anderson. This device provides a rotary coupon placer mechanism similar to that of Matzen with the exception that it employs a chain drive in place of the gear transmission of Matzen. Again, the pick-off arms which carry the coupons from the dispenser station to the receiver station are rotatably driven along an arcuate path which is directed inwardly towards the central axis.

In both the Matzen and Anderson devices the gear ratio, sun gear to planetary gear, is considerably in excess of 3:2 and the pitch center, sun gear to planetary gear, is greater than the radial extent of the pick-off arm. It has been found that by employing a 3:2 gear ratio of sun gear to planetary gear and a pitch center, sun gear to planetary gear, which is equal to half the radial extent of the pick-off arm from the axis of the planetary gear, there is provided an apparatus in which the outer end of the pick-off arm follows an arcuate path between the dispenser station and the receiver station which is described outwardly of the axis of the planetary gear with respect to the axis of the sun gear. With this mechanism, the articles which are transferred are not drawn inwardly of the rotating mechanism in moving from the dispenser station to the pick-off station and consequently large items such as knock-down carton blanks may be transferred. Furthermore, by reason of the fact that the pitch centers of the sun gear with respect of the planetary gear is less than the radial extent of the pick-off arm, the entire drive train for the same length of arcuate movement along the transfer path is much more compact so that the velocity of the major portion of the mass of the mechanism of the present invention is considerably less than that of the comparable Matzen and Anderson mechanisms.

SUMMARY OF INVENTION

According to an embodiment of the present invention there is provided a rotary transfer mechanism having a dispenser station and a receiver station disposed equidistant from a central axis, carriage means mounted on said frame for rotation about a central axis, stationary gear means mounted on said frame in axial alignment with said first axis and disposed adjacent said carriage, idler gear means mounted for free rotation of said carriage means in meshed engagement with said stationary gear means for rotation about said stationary gear in response to rotation of said carriage about said central axis, third gear means mounted on said carriage in meshed engagement with said idler gear to be rotatably driven by said idler gear about said central axis in response to rotation of said carriage about said central axis, transfer means mounted on said carriage for rotation with respect to said second axis with said third gear means, said transfer means including pick-off arm means projecting radially from said second axis, said pick-off arm means having an outer arm projecting into said dispenser station and receiver stations in response to rotation of said carriage means and drive means for rotatably driving the carriage about the said first axis to cause said transfer means to move in a path which extends into and out of said dispenser station and said receiver station in sequence, the improvement wherein the gear ratio of said stationary gear with respect to said third gear is 3:2 and the radial extent of said pick-off arm means from said second axis equals twice the pitch center of distance between said stationary gear and said third gear means.

PREFERRED EMBODIMENT

The invention will be more clearly understood after reference to the following detailed specification read in conjunction with the drawings wherein.

Figure 1:
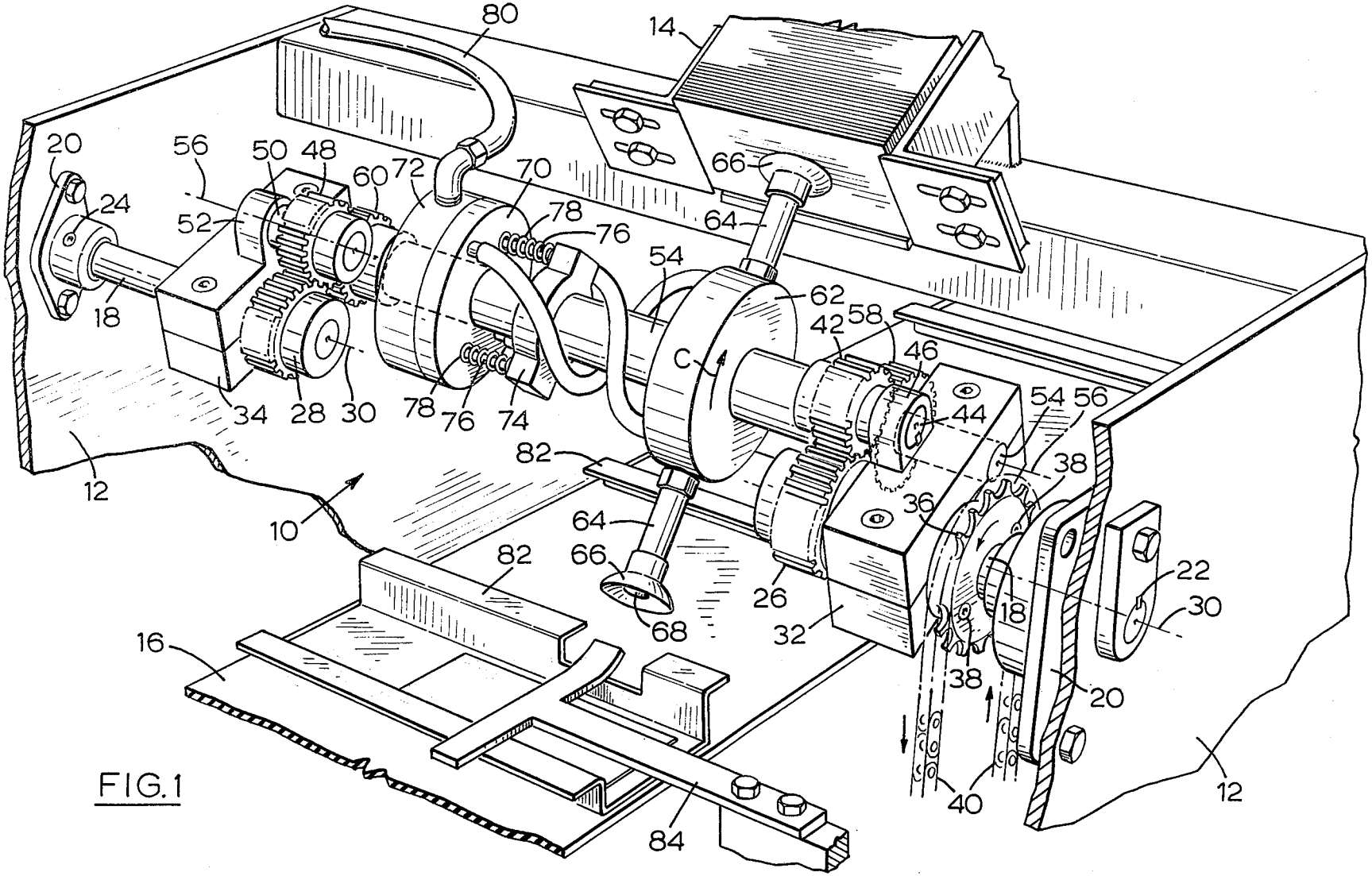
FIG. 1 is a partially sectioned pictorial view of a rotary transfer mechanism according to an embodiment of the present invention.

With reference to the drawings, the reference numeral 10 refers generally to a rotary transfer mechanism according to an embodiment of the present invention. The transfer mechanism of the present invention may be used in a coupon placing apparatus as illustrated in FIG. 1 of the drawings or in a carton opening device wherein knocked-down cartons are withdrawn from a carton storage station, opened and deposited onto a continuously moving conveyor.

In the embodiment of the invention illustrated in FIG. 1 the rotary transfer mechanism is mounted in a frame 12 which supports a coupon storage magazine 14 and a coupon receptacle conveyor 16. The transfer mechanism includes a pair of stub shafts 18 which are rigidly secured with respect to the frame 12 by means of mounting brackets 20. Rotation of the stub shafts 18 with respect to the mounting brackets 20 is prevented by a suitable key 22 and locking cup screws 24. A first sun gear 26 is rigidly mounted adjacent the outer end of a first of the stub shafts 18 and a second sun gear 28 is mounted at the outer end of the other stub shaft 18. The sun gears 26 and 28 are fixed with respect to the shafts 18 so that they are stationary. The shafts and sun gears 26 and 28 are axially aligned on a central axis 30. A first carriage member 32 is mounted for rotation on the first stub shaft 18 and a second carriage member 34 is mounted for rotation on the second stub shaft 18. Each of the carriage members 32 and 34 are in two halves which are bolted together in a position extending about their respective stub shafts 18. A drive sprocket 36 is mounted for rotation on the first stub shaft 18 and is rigidly secured with respect to its adjacent carriage member 32 by means of mounting screws 38. The sprocket 36 is rotatably driven by means of a chain 40 from a suitable drive means (not shown) such as an electric motor and the like which is synchronized with respect to the longitudinal movement of the conveyor 16. Rotation of the drive sprocket 36 results in rotation of the first carriage member 32 with respect to the first stub shaft 18. An idler gear 42 is mounted for free rotation of a shaft 44 which is keyed to the lug 46 which projects outwardly from the main body of the first carrier member 32. Similarly an idler gear 48 is mounted for rotation on shaft 50 which is rigidly mounted on lug 52 which is an integral part of the second carriage member 34.

A shaft 54 is mounted for rotation at one end in the first carriage member 32 and at the other end in the second carriage member 34 about a second axis 56; a third gear 58 is keyed to the shaft 54 adjacent the first carriage member 32 and a similar third gear 60 is keyed to the shaft 54 adjacent the second carriage member 34. The shaft 54 is rotatably driven with respect to the carriages 32 and 34 in response to rotation of the third gears 58 and 60 in use. A circular disc member 62 is rigidly secured with respect to the shaft 54 for rotation therewith.

A pair of pick-off arms 64 are mounted on and project outwardly from the circular disc member 62 on diametrically opposite sides of the disc 62. Suction cups 66 are mounted at the ends of the shafts 64. The suction cups 66 have a vacuum passage 68 opening therethrough communicating with the hollow interior of the arms 64 and through convenient venting passages (not shown) in the disc 62 to communicate with flexible hose members 68. The other ends of the hose members 68 are connected to a vent disc 70 which is slidably mounted on shaft 54 for longitudinal movement with respect thereto. Disc 70 is held in contact with a free floating disc 72 by means of a bracket 74, carriage shafts 76 and springs 78. The purpose of this venting mechanism is to permit the continuously rotating suction cups to be connected to a stationary vacuum source and in this respect any suitable mechanism for achieving this purpose may be used in place of that illustrated in FIG. 1. It will be understood that annular passages are formed in the abutting faces of discs 70 and 72 which provide the timing of the application of the vacuum required at the suction cups 66 and 68 to achieve the required transfer and release of the article which is being transferred. The disc 72 is connected to a suitable source of vacuum by means of a flexible hose 80.

As previously indicated, a receiver conveyor 16 extends through the receiver station. The receiver conveyor 16 has a plurality of article receiving compartments 82 mounted at spaced intervals along the length thereof to receive the articles which are transferred from the dispenser station. A hold-down bar 84 serves to retain the coupons within the receivers 82 after they have been discharged by the suction cups.

As previously indicated, the mechanism of the present invention may also be used to advantage in a carton opening device wherein cartons are removed in a knocked-down configuration from the dispenser station and opened to a sleeve-like configuration by contact with a suitable striker carried by the conveyor mechanism and thereafter deposited to a suitable receptacle on the receiving station conveyor.

Figure 2:
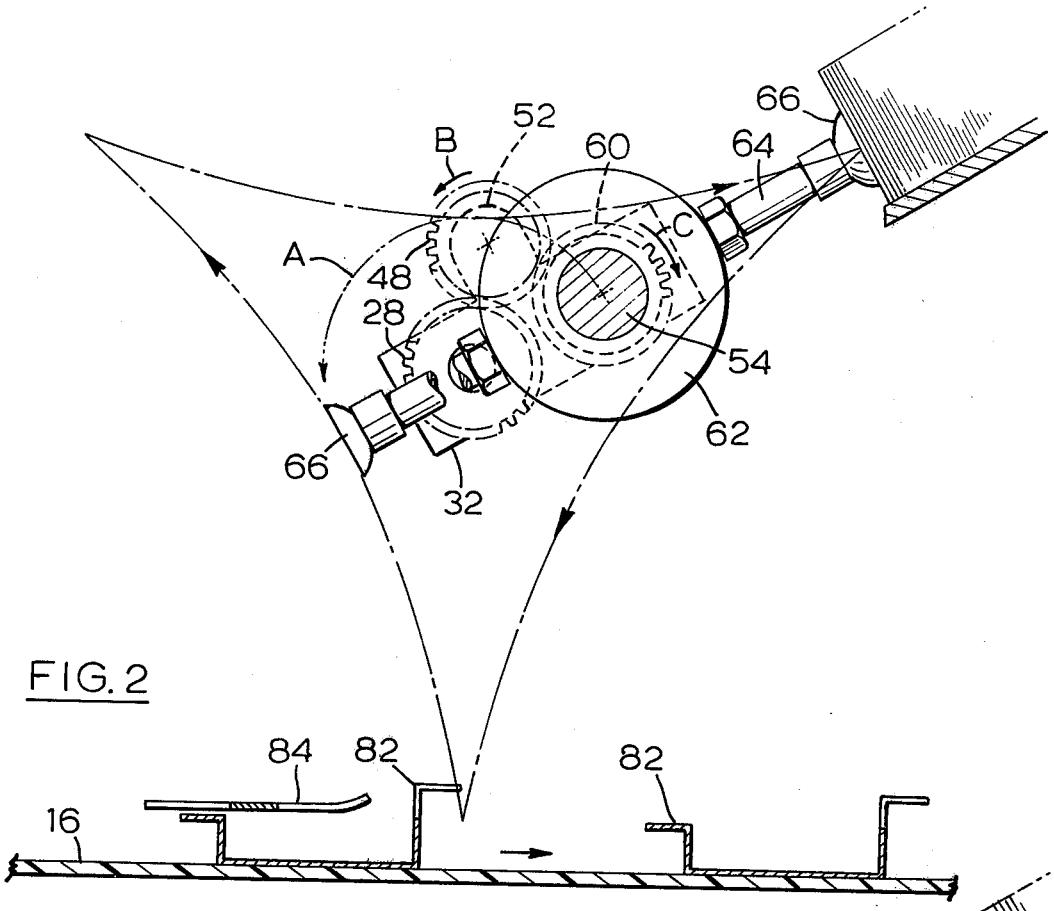
FIG. 2 is an end view illustrating the transfer mechanism in an operative position to remove an item from the dispenser station.
Figure 3:
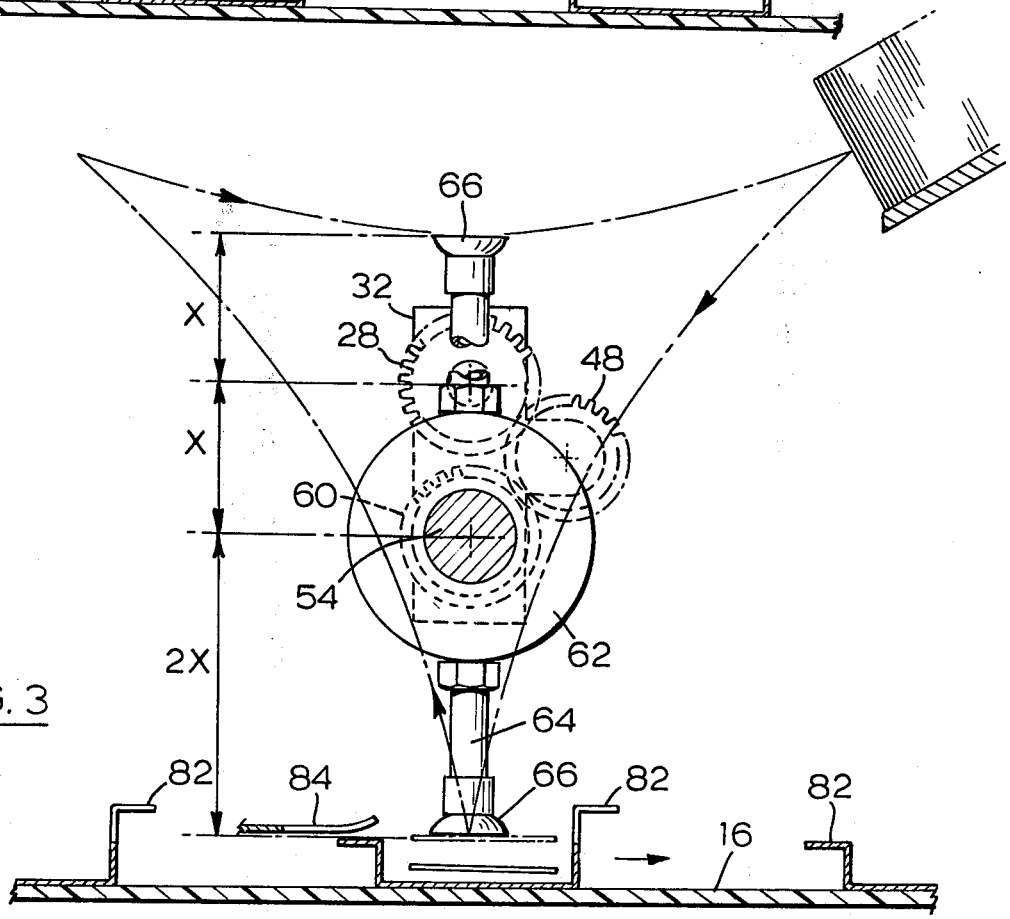
FIG. 3 is an end view illustrating the transfer mechanism in an operative position to discharge an item into the receiver station.

As shown in FIGS. 2 and 3 of the drawings, rotation of the carriage member 32 in the direction of the arrow A causes rotation of the idler gear 42 in the direction of the arrow B which drives the third gear 26 in the direction of the arrow C so that the shaft 54 and disc 62 are also rotatably driven in the direction of the arrow C.

I have found that I can cause the suction cups to move along the path D, in the direction of the arrows indicated, in response to rotation of the carrier 32, in the direction of the arrow A, by selecting a sun gear 26 to third gear 58 ratio of 3:2 and by providing a pitch center length X between the centers of sun gear 26 and third gear 58 which is equal to half of the radial length from the suction cup 66 to the center of the third gear 58. As shown in FIG. 3 of the drawings, when the pitch center between gears 60 and 28 is equal to X, the radial extent of the pick-off arm 64 is equal to 2X. With this relationship, it will be noted that the suction cups 66 in passing along the path D are continually oriented so as to be outwardly directed with respect to the central axis 30 so that relatively large items such as cartons may be moved from the dispenser mechanism to the receiver station without difficulty. By reason of this mechanism, a very high speed transfer can be achieved without establishing any large mass of rotating members spaced at substantial distances from the center of rotation as in the case of the devices of the prior art.

I have found that by employing the gear ratios described above and the pitch centers and arm radiuses previously described, it is possible to move the suction cups along the path D without any looping of the path at its outer end so that there is no lateral movement or scuffing between the suction cup and the dispenser station which could otherwise prevent accurate seating of the suction cup on the surface of the items which are to be removed from the dispenser.

It will be apparent that the gears 48 and 60 are driven by rotation of the shaft 54 so that the gear ratios are not important to the operation of the transfer mechanism. I have found, however, that if the gear 28 and gear 60 are of a 1:1 ratio, the gear 60 may be rigidly secured with respect to the disc 72, the gear 60 being free to rotate on shaft 54. The gear 60 will serve to retain the disc 72 in the stationary position with the discharge nipple extending upwardly therefrom for all positions of the shaft 54 with respect to the central axis 30.

From the foregoing it will be apparent that the present invention provides improvements in a rotary transfer mechanism which considerably simplify the structure of the rotary transfer mechanism and provide a simple and rugged structure which does not include any substantial proportion of its mass disposed at a substantial distance from its central axis of rotation. Furthermore, the transfer mechanism is capable of causing the suction cup devices to follow a perfect hypotrochoidal path while maintaining the suction cups in a position in which they are outwardly directed with respect to the central axis of rotation for all rotational positions of the transfer mechanism.

Figure 4:
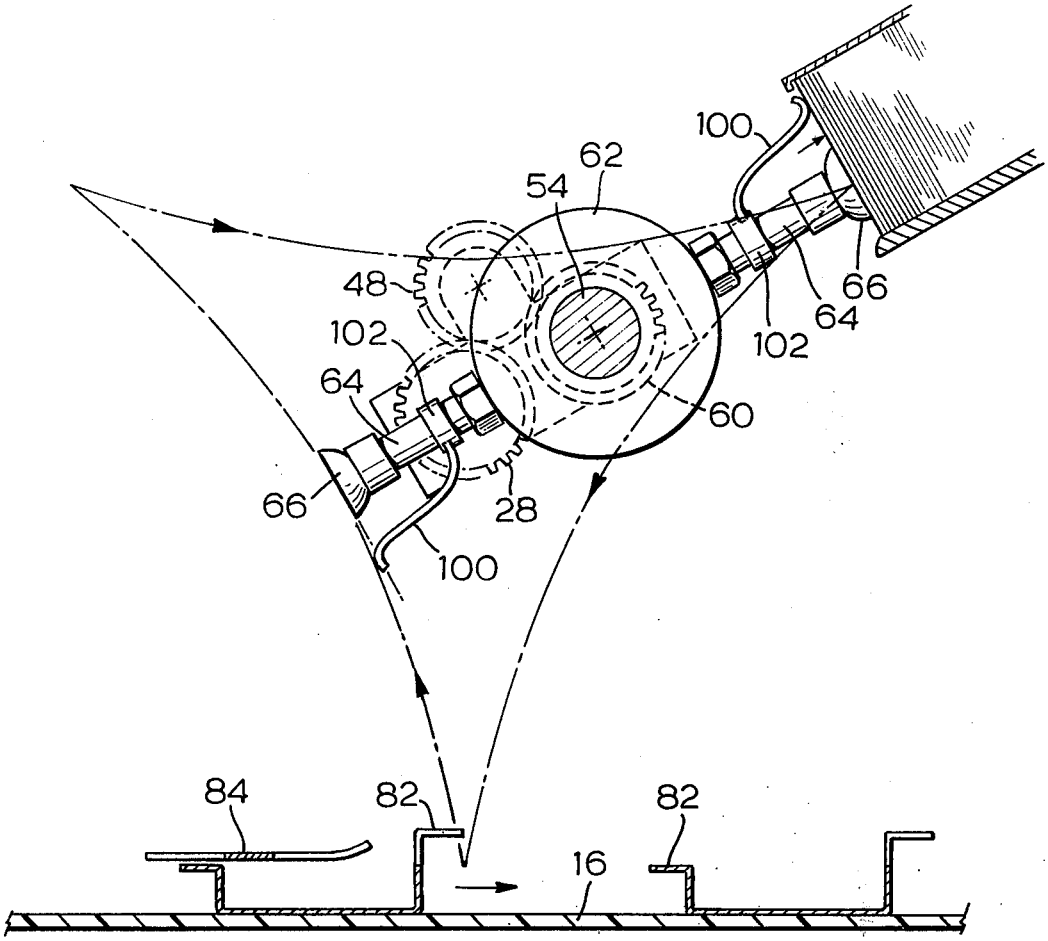
FIG. 4 is an end view illustrating a modified transfer mechanism.

In the embodiment illustrated in FIG. 4 of the drawings the pick-off arm 64 has been modified to include a finger member 100 which is secured to the arm 64 by means of a collar 102 in a position such that the outer end of the finger 100 will strike the leading blank in the storage station after the suction cup 66 has engaged the blank so that an upper edge of the blank is moved rearwardly to facilitate the withdrawal of the blank from the storage station in use. This modification is particularly useful when blanks such as knocked-down carton blanks are being withdrawn from a storage station.

The advantages of the present invention will be apparent to those skilled in the art without departing from the scope of the invention.

What I claim as my invention is:

1. A rotary transfer mechanism for transferring items from a dispenser station to a receiver station which is circumferentially spaced 120° in a first angular direction from the dispenser station in an arc generated about a central axis, the transfer mechanism comprising; a frame having a carriage member mounted for rotation thereon about said central axis, a stationary gear mounted on the frame in axial alignment with said central axis and disposed adjacent said carriage, idler gear means mounted for free rotation on said carriage in meshed engagement with said stationary gear means for rotation about said stationary gear means in response to rotation of said carriage about said central axis, third gear means mounted on said carriage in meshed engagement with said idler gear means to be rotatably driven by said idler gear means about a second axis in response to rotation of said carriage about said central axis, a transfer head means mounted on said carriage for rotation about said second axis with said third gear means, said transfer head means including, a pair of diametrically opposed pick-off arms projecting radially from said second axis, each of said pick-off arms having a pick-off head at the radially outer end thereof, drive means for rotatably driving the carriage about said central axis in a direction opposite to said first angular direction, the radial distance from the pick-off heads to the second axis being twice the pitch center distance between the stationary gear and the third gear, whereby rotation of said carriage about said central axis as aforesaid in the direction opposite to said first angular direction causes movement of said pick-off head in said first angular direction along an arcuate path which extends between said dispenser station and said receiver station, said arcuate path having a concave curvature in the direction towards said second axis such that the article which is transferred is rotated upon itself through an arc of no more than 120°.

* * * * *